US009578687B2

(12) United States Patent
Giffels et al.

(10) Patent No.: US 9,578,687 B2
(45) Date of Patent: Feb. 21, 2017

(54) CONTINUOUS-FLOW HEATER

(71) Applicant: BorgWarner BERU Systems GmbH, Ludwigsburg (DE)

(72) Inventors: Thomas Giffels, Stuttgart (DE); Andreas Nagora, Bretten (DE); Alexander Dauth, Maulbronn (DE); Ralf Wächter, Pfinztal (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 229 days.

(21) Appl. No.: 14/284,065

(22) Filed: May 21, 2014

(65) Prior Publication Data

US 2014/0348497 A1 Nov. 27, 2014

(30) Foreign Application Priority Data

May 23, 2013 (DE) ..... 10 2013 105 270

(51) Int. Cl.

| | |
|---|---|
| ***H05B 3/50*** | (2006.01) |
| ***H05B 3/00*** | (2006.01) |
| ***F24H 1/14*** | (2006.01) |
| ***F24H 1/12*** | (2006.01) |
| ***H05B 3/14*** | (2006.01) |
| ***H05B 3/24*** | (2006.01) |
| ***F24H 9/00*** | (2006.01) |

(52) U.S. Cl.

CPC ..... *H05B 3/00* (2013.01); *F24H 1/121* (2013.01); *F24H 9/0015* (2013.01); *H05B 3/141* (2013.01); *H05B 3/24* (2013.01); *H05B 3/50* (2013.01); *F24H 2250/04* (2013.01); *H05B 2203/02* (2013.01)

(58) Field of Classification Search

USPC ..... 392/492, 493

See application file for complete search history.

(56) References Cited

U.S. PATENT DOCUMENTS

| | | | | |
|---|---|---|---|---|
| 1,640,047 A * | 8/1927 | Nesmith | F24H 1/102 392/482 |
| 4,177,375 A | 12/1979 | Meixner | |
| 5,887,559 A * | 3/1999 | Ban | B60H 1/00571 122/26 |
| 6,178,292 B1 * | 1/2001 | Fukuoka | F24H 1/009 165/175 |
| 6,477,324 B1 * | 11/2002 | Sun | F24H 1/142 165/172 |

(Continued)

FOREIGN PATENT DOCUMENTS

| | | |
|---|---|---|
| DE | 77 30 201 U1 | 3/1979 |
| DE | 10 2010 031 520 A1 | 1/2012 |

(Continued)

*Primary Examiner* — Joseph M Pelham

(74) *Attorney, Agent, or Firm* — Bose McKinney & Evans LLP

(57) ABSTRACT

The invention relates to a continuous-flow heater having a housing, which comprises an inlet opening and an outlet opening, and a heater housing, which comprises at least one tubular chamber, in which at least one heating element is arranged. In accordance with this disclosure a plurality of ribs are arranged on a front side and a rear side of the heater housing, said ribs defining, between themselves, flow channel portions for liquid to be heated.

14 Claims, 1 Drawing Sheet

(56) References Cited

U.S. PATENT DOCUMENTS 8,463,117 B2 * 6/2013 Yeung ..... F24H 1/106 392/465
8,607,694 B2 * 12/2013 Blanc ..... A47J 31/54 392/479
8,934,764 B2 * 1/2015 Wei ..... B60H 1/2221 392/465
9,161,391 B2 * 10/2015 Niederer ..... H05B 3/24 392/485
2003/0141381 A1 * 7/2003 Bissonnette ..... B05B 1/24 239/132
2004/0264951 A1 * 12/2004 Kuebler ..... B60S 1/488 392/485
2005/0047768 A1 * 3/2005 Kuebler ..... B60S 1/488 392/493
2008/0000889 A1 * 1/2008 Niederer ..... B60H 1/2221 219/205
2011/0069943 A1 3/2011 Luppold et al.
2012/0087642 A1 * 4/2012 Bohlender ..... H05B 3/24 392/465
2012/0330234 A1 * 12/2012 Balluff ..... A61M 5/44 604/114
2013/0186966 A1 * 7/2013 Taguchi ..... B60H 1/2221 237/57
2013/0287379 A1 * 10/2013 Yoshitomi ..... F24H 9/146 392/486
2015/0110479 A1 * 4/2015 Wu ..... F24H 9/2028 392/490
2015/0117847 A1 * 4/2015 Reinholz ..... F24H 1/142 392/485
2015/0168010 A1 * 6/2015 Jansen ..... F24H 1/103 392/484

FOREIGN PATENT DOCUMENTS

DE 10 2011 050 992 A1 12/2012
EP 2 295 886 A2 3/2011

* cited by examiner

CONTINUOUS-FLOW HEATER

RELATED APPLICATIONS

This application claims priority to DE 10 2013 105 270.3, filed May 23, 2013, which is hereby incorporated herein by reference in its entirety.

BACKGROUND AND SUMMARY

The present invention relates to a continuous-flow heater. Continuous-flow heaters are generally known from EP 2 295 886 A2. The present invention provides a way in which the efficiency of such a continuous-flow heater can be increased.

With a continuous-flow heater according to this disclosure a plurality of ribs are arranged on a front side of the heater housing and on a rear side of the heater housing opposite the front side, said ribs defining, between themselves, a sequence of flow channel portions. The heater housing is thus arranged in an interior of the continuous-flow heater. Liquid to be heated flows from the inlet opening to the outlet opening of the continuous-flow heater and thereby flows both along the front side and along the rear side of the heater housing from one flow channel portion to the next adjacent flow channel portion. The ribs can be integrally moulded on the outer housing or can be part of the heater housing. The ribs have a dual function since on the one hand they define the channel portions through which the liquid to be heated flows and on the other hand enlarge the heat transfer area. Heat is therefore transferred very efficiently to the liquid to be heated.

The liquid flow can be divided in the continuous-flow heater into two halves. One half then flows along the front side of the heater housing, and the other half then flows along the rear side. It is also possible for the entire liquid flow to be guided initially along one of the two sides, for example the front side, and then along the other side, for example the rear side.

The heater housing may be an extruded profile, for example, which has one or more chambers, in each of which at least one electric heating element, for example a ceramic PTC element, is arranged.

A plurality of heating elements can be arranged in each tubular chamber of the heater housing. The heating elements in a tubular chamber form a heating rod. Each heating rod contains one or two contact plates, and may also contain a frame, which connects the contact plate(s) to the heating elements to form a unit that can be easily handled during the installation process.

In an advantageous refinement of this disclosure, the heater housing has a plurality of tubular chambers extending parallel to the ribs, and the ribs are arranged centrally above the chambers. Heat that is generated by heating elements arranged in the chambers can thus be delivered particularly efficiently.

In an advantageous refinement of this disclosure, the housing of the continuous-flow heater, which comprises the inlet opening and the outlet opening, is composed of a flat tube and two closure parts, which are attached at the ends of the flat tube. The flat tube and the two closure parts can be locked or welded to one another, for example. The flat tube can be produced as an extruded profile. Alternatively or additionally to ribs of the heater housing, the flat tube can be provided with ribs in order to define flow channel portions.

The flow path of the liquid to be heated can be formed by the configuration of the closure parts, such that the liquid flows along the front side and along the rear side of the heater housing in series or is divided into two parts, one of which flows only along the front side and the other of which flows only along the rear side of the heater housing.

The inlet and outlet openings and electrical connections of the heating elements can be integrated in the closure parts. The inlet opening and the outlet opening may be arranged in different closure parts or in the same closure.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure. Further, it should be understood that various structural terms used throughout this disclosure and claims should not receive a singular interpretation unless it is made explicit herein. By way of example, the terms "heating element," "flow path," "tubular chamber," to name just a few, should be interpreted when appearing in this disclosure and claims to mean one or more. All other terms used in this disclosure and claims should be similarly interpreted unless it is made explicit that a singular interpretation is intended.

Figure 2:
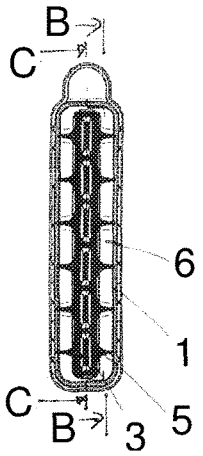
FIG. 2 shows a sectional view along the line of section AA of FIG. 1.
Figure 1:
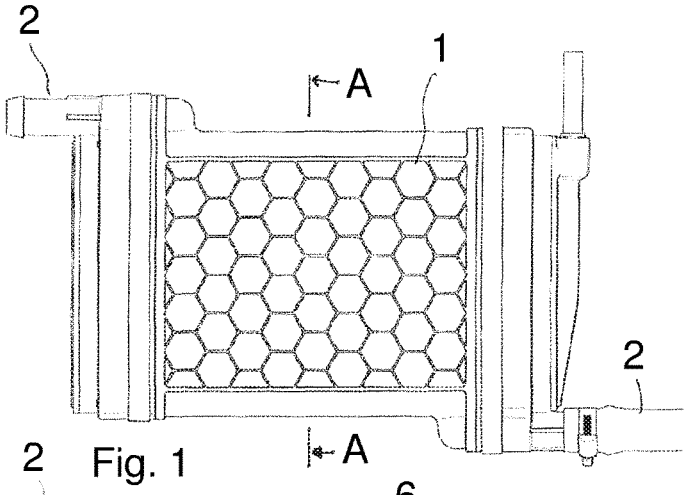
FIG. 1 shows a continuous-flow heater.
Figure 3:
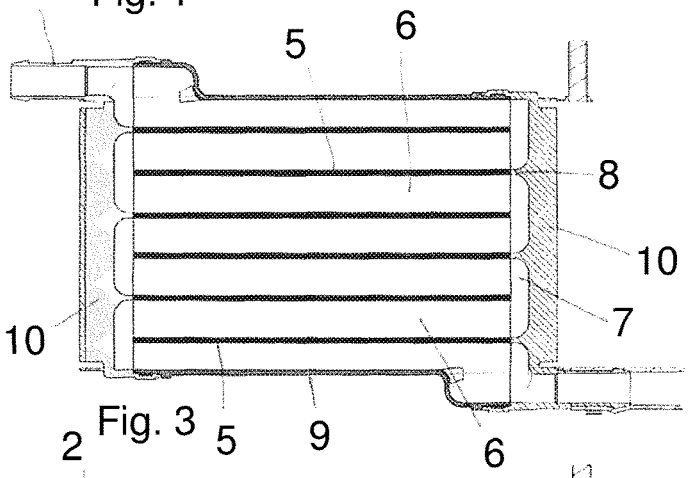
FIG. 3 shows a sectional view along the line of section BB of FIG. 2.
Figure 4:
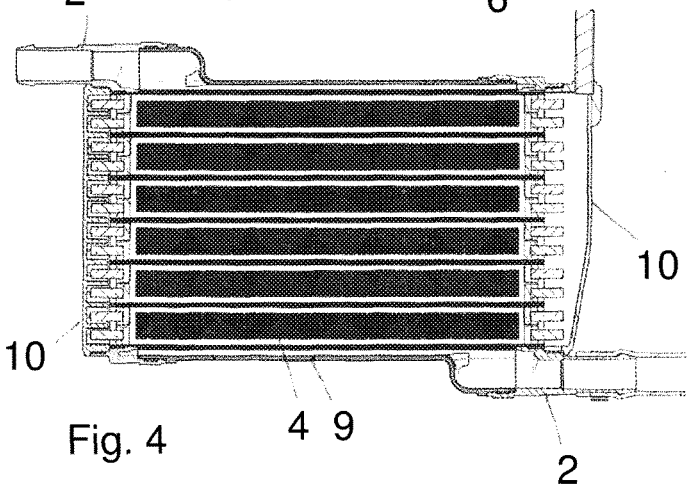
FIG. 4 shows a sectional view along the line of section CC of FIG. 2.

The continuous-flow heater illustrated in FIGS. 1 to 4 has an outer housing 1, which comprises inlet and outlet openings 2. The housing 1 may be a double-walled housing in order to reduce heat losses. A heater housing 3 is arranged in the housing 1. The heater housing 3 has tubular chambers, in each of which at least one ceramic heating element 4, for example a PTC heating element, is arranged. The heater housing 3 has ribs 5 on its front side and on its rear side. These ribs define, between themselves and the outer housing 1, a first sequence of flow channel portions 6 for the liquid to be heated on the front side of the heater housing 3 and a second sequence of flow channel portions 6 on the rear side of the heater housing 3. Liquid to be heated thus flows from the inlet opening to the outlet opening along the front side and along the rear side of the heater housing 3 from one flow channel portion 6 to the next adjacent flow channel portion 6. Thus the directions of flow in adjacent flow channel portions 6 of each sequence are opposite to each other.

The outer housing 1 may rest against the end faces of the heater housing 3 and may connect adjacent flow channel portions by recesses, for example indentations 7. An elevation 8, which bears against the end of a rib 5, is preferably arranged between every two adjacent indentations 7. At the location of such indentations 7 and elevations 8, adjacent flow channel portions may also be connected in that each second rib 5 at each of the two end faces of the heater housing 3 is slightly shorter or has an opening.

The housing 1 can be composed of a flat tube 9 and two closure parts 10. The inlet and outlet openings 2 of the housing 1 can be provided on the closure parts 10. It is also possible however to provide the inlet and outlet openings 2 on the flat tube 9. The inlet and outlet openings 2 are preferably attached on a narrow side of the housing 1. The flat tube 9 may be a double-walled flat tube to improve the heat insulation.

The tubular chambers of the heater housing 3 can be closed in a liquid-tight manner by the closure points 10, for example in that the closure parts 10 comprise closure elements, for example stopper-like protrusions, which are pressed into the tubular chambers.

The tubular chambers of the heater housing 3 can also be closed by separate closure elements, for example stoppers. The heating elements can be contacted in the heater housing 3 with contact plates, which protrude into one of the closure parts 10. If closure elements such as stoppers or the like are provided at the end in question of the heater housing 3, the contact plates may protrude through the closure elements.

A control electronics unit may be arranged in one of the two closure parts 10 in order to switch on and off the electric heating elements 4 in the individual chambers of the heater housing 3. Each chamber of the heater housing 3 may form a heating section, to which current is supplied independently of the other heating sections. For this purpose, the control electronics unit may have a transistor switch for each heating section. In the illustrated embodiment the two closure parts 10 are formed differently so as to create more space for a control electronics unit. The two closure parts 10 may also be formed identically however.

The heater housing 3 may be produced for example as an extruded profile which forms a number of tubes, in which the heating elements 4 are then arranged. The heater housing 3 can be produced for example from aluminium. Plastics material and/or aluminium for example can be used for the outer housing 1.

The heating elements 4 can be arranged in the heater housing 3 between two contact plates, each of which is electrically insulated with respect to the heater housing. It is also possible to electrically insulate just one of the two contact plates with respect to the heater housing 3 or to electrically contact the heating elements 4 on one side via the heater housing 3, that is to say to use the heater housing 3 as an earth contact. It is likewise possible to insert separate tubes or sleeves into the tubular chambers of the heater housing 3, the heating elements 4 being arranged in said tubes or sleeves.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A continuous-flow heater, comprising:

a housing having an inlet opening and an outlet opening;

a heater housing having a tubular chamber in which a heating element is arranged;

a plurality of ribs arranged on a front side and on a rear side of the heater housing; and a flow path defined between the ribs configured for liquid to be heated, the flow path comprising a sequence of flow channel portions;

wherein the tubular chamber comprises a plurality of tubular chambers extending parallel to the ribs, the ribs being arranged centrally above the chambers.

2. The continuous-flow heater according to claim 1, wherein a first sequence of flow channel portions on the front side of the heater housing is connected in series to a second sequence of flow channel portions on the rear side of the heater housing.

3. The continuous-flow heater according to claim 1, wherein a first sequence of flow channel portions on the front side of the heater housing is connected in parallel to a second sequence of flow channel portions on the rear side of the heater housing.

4. The continuous-flow heater according to claim 1, wherein the inlet opening and the outlet opening are arranged on a narrow side of the housing.

5. The continuous-flow heater according to claim 1, wherein the housing comprises a flat tube and two closure parts attached at the ends of the flat tube.

6. The continuous-flow heater according to claim 5, wherein the inlet opening is provided in one of the two closure parts and the outlet opening is provided in the other of the two closure parts.

7. The continuous-flow heater according to claim 5, wherein the ribs run in a straight line and parallel to one another in the longitudinal direction of the flat tube.

8. The continuous-flow heater according to claim 7, wherein the closure parts comprise recesses on an inner face, the recesses connecting the adjacent flow channel portions between the ribs of the heater housing.

9. The continuous-flow heater according to claim 5, wherein at least one of the two closure parts closes an end of the tubular chamber.

10. The continuous-flow heater according to claim 5, wherein at least one of the two closure parts comprises a closure element for the tubular chamber, the closure element being pressed into the chamber.

11. The continuous-flow heater according to claim 1, wherein the heater housing has an extruded profile.

12. The continuous-flow heater according to claim 1, wherein the heating element comprises a plurality of heating elements.

13. The continuous-flow heater according to claim 1, wherein the tubular chamber comprises a plurality of chambers and the heating element comprises a plurality of heating elements, at least one heating element being arranged in each tubular chamber.

14. A continuous-flow heater, comprising:

a housing having an inlet opening and an outlet opening;

a heater housing having a tubular chamber in which a heating element is arranged;

a plurality of ribs arranged on a front side and on a rear side of the heater housing; and a flow path defined between the ribs configured for liquid to be heated, the flow path comprising a sequence of flow channel portions;

wherein the housing comprises a flat tube and two closure parts attached at the ends of the flat tube, and wherein each closure part includes a plurality or recesses connecting the adjacent flow channel portions between the ribs of the heater housing.

* * * * *